United States Patent [19]

Chace

[11] 4,241,581

[45] Dec. 30, 1980

[54] SYNCHRONIZER FOR HYDRAULIC ACTUATORS

[75] Inventor: Richard A. Chace, Bellevue, Wash.

[73] Assignee: The Boeing Company, Seattle, Wash.

[21] Appl. No.: 966,672

[22] Filed: Dec. 5, 1978

[51] Int. Cl.[3] ..... F15B 7/02

[52] U.S. Cl. ..... 60/538; 60/546; 60/567; 60/581; 60/591; 91/39; 91/520

[58] Field of Search ..... 60/537, 538, 539, 546, 60/567, 571, 581, 591, 484, 486; 91/39, 36, 37, 40, 520; 92/68

[56] References Cited

U.S. PATENT DOCUMENTS

| | | | |
|---|---|---|---|
| 3,001,369 | 9/1961 | Allais | 60/537 |
| 3,020,720 | 2/1962 | Spalding | 91/39 |
| 3,022,738 | 2/1962 | Krute | 91/39 |
| 3,093,971 | 6/1963 | Van Deberg | 60/538 |
| 3,135,210 | 6/1964 | English | 91/39 |

*Primary Examiner*—Abraham Hershkovitz
*Attorney, Agent, or Firm*—Thomas H. Murray

[57] ABSTRACT

A synchronizer is provided for synchronizing the movements of two hydraulic actuators. The synchronizer consists of a two-piston pump which supplies hydraulic fluid to both actuators. The two pistons are mechanically connected so as to move simultaneously through equal distances, and on each complete stroke of the pump, each actuator receives fluid from both cylinders of the pump, so that both actuators receive precisely equal amounts of fluid.

7 Claims, 2 Drawing Figures

SYNCHRONIZER FOR HYDRAULIC ACTUATORS

BACKGROUND OF THE INVENTION

The present invention relates to the problem of supplying accurately identical volumes of hydraulic fluid to two hydraulic actuators, or servo motors, so as to accurately synchronize their movement.

There are many situations where the movement of two elements or devices must be accurately synchronized and where hydraulic actuators are used to move the elements. In aircraft, for example, the thrust reversers which reverse the direction of thrust of the jet engines, for braking the craft on landing, are operated by hydraulic actuators. The movement of the actuators must be accurately synchronized so that the thrust reversers are moved in synchronism even though the loads on the actuators may differ. Various aircraft control surfaces, such as leading edge flaps, trailing edge flaps, and others which are hydraulically actuated must also be accurately synchronized. The problem is not limited to aircraft, of course, as there are many other types of equipment operated by hydraulic actuators in which the movement of two devices, such as machine elements, clamps, and other jointly movable devices, must be accurately synchronized.

Hydraulic systems of the type used for this purpose consist in general of a suitable source of high-pressure hydraulic fluid with valve means suitably arranged and controlled to supply the hydraulic fluid to two separate hydraulic actuators. In the types of equipment mentioned above, where it is necessary to synchronize the movements of the two actuators as closely as possible, synchronizing means must also be provided so that the devices to be moved by the actuators will move in synchronism with each other. The varying conditions of the actuators, such as different loads and dimensional differences, make it very difficult to achieve the desired accuracy which requires supplying exactly equal amounts of fluid to both actuators.

Various expedients have been proposed heretofore for synchronizing the movements of two hydraulic actuators. For example, it has been attempted to attain an accurate division of flow by causing the hydraulic fluid to flow through orifices. The actuators to be synchronized, however, often have different loads so that the back-pressure on the orifices is different and the flows differ correspondingly, frequently by more than 5%. Another method of synchronizing which has been used involves the provision of two auxiliary actuators each having equivalent volume to the actuators to be synchronized. The auxiliary actuators are mechanically tied together so that their simultaneous movement supplies equivalent volume to each of the actuators to be synchronized. The auxiliary actuators must, therefore, be of equal size to the actuators to be synchronized, so that this expedient requires as much additional space as the actuators themselves as well as the additional weight of the auxiliary actuators. Still another proposed method is to arrange the actuators to be synchronized in series in such a way that hydraulic fluid from one of the actuators drives a second actuator and they move together in synchronism. This arrangement, however, requires that the first actuator be twice the size of the second actuator, so as to have sufficient capacity for the hydraulic fluid, and the weight and size of the complete equipment are correspondingly increased. Both of these latter methods, therefore, are especially undesirable for aircraft use because of the increased space required and the severe weight penalty involved, neither of which are acceptable.

SUMMARY OF THE INVENTION

The present invention provides a synchronizer for hydraulic actuators which functions as a pump to supply precisely identical volumes of hydraulic fluid to each of two hydraulic actuators, so that they move together exactly in synchronism.

In accordance with the invention, a two-piston pump is provided, with the pistons mechanically connected together in a manner to cause them to move simultaneously through exactly equal distances. The pistons move in hydraulic cylinders and hydraulic fluid is supplied alternately to opposite ends of each cylinder to cause the pistons to move continuously back and forth. When the pistons are moving in one direction, hydraulic fluid is forced from each cylinder to one of the two actuators to be synchronized, and when the pistons reverse and move back in the opposite direction, hydraulic fluid is forced from each cylinder to the other of the hydraulic actuators. In this way, on each complete stroke or cycle of movement of the pistons, both actuators are supplied with identical total volumes of fluid from the two cylinders, since the strokes of both pistons are identical. The supply of hydraulic fluid to the cylinders is controlled by a servo valve which is actuated by an electronic oscillator, or similar means, to cause the pistons to reciprocate continuously at a relatively high frequency to provide a substantially continuous flow of fluid to the actuators. Since the volume of fluid supplied to both actuators on each complete stroke of the pistons is identical, the actuators move together precisely in synchronism even though the areas or diameters of the two pistons may not be the same. In this way, the movement of two hydraulic actuators can be synchronized to within about 0.10% as compared with an accuracy of not less than 5% which was the best attainable with known types of synchronizers.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1:
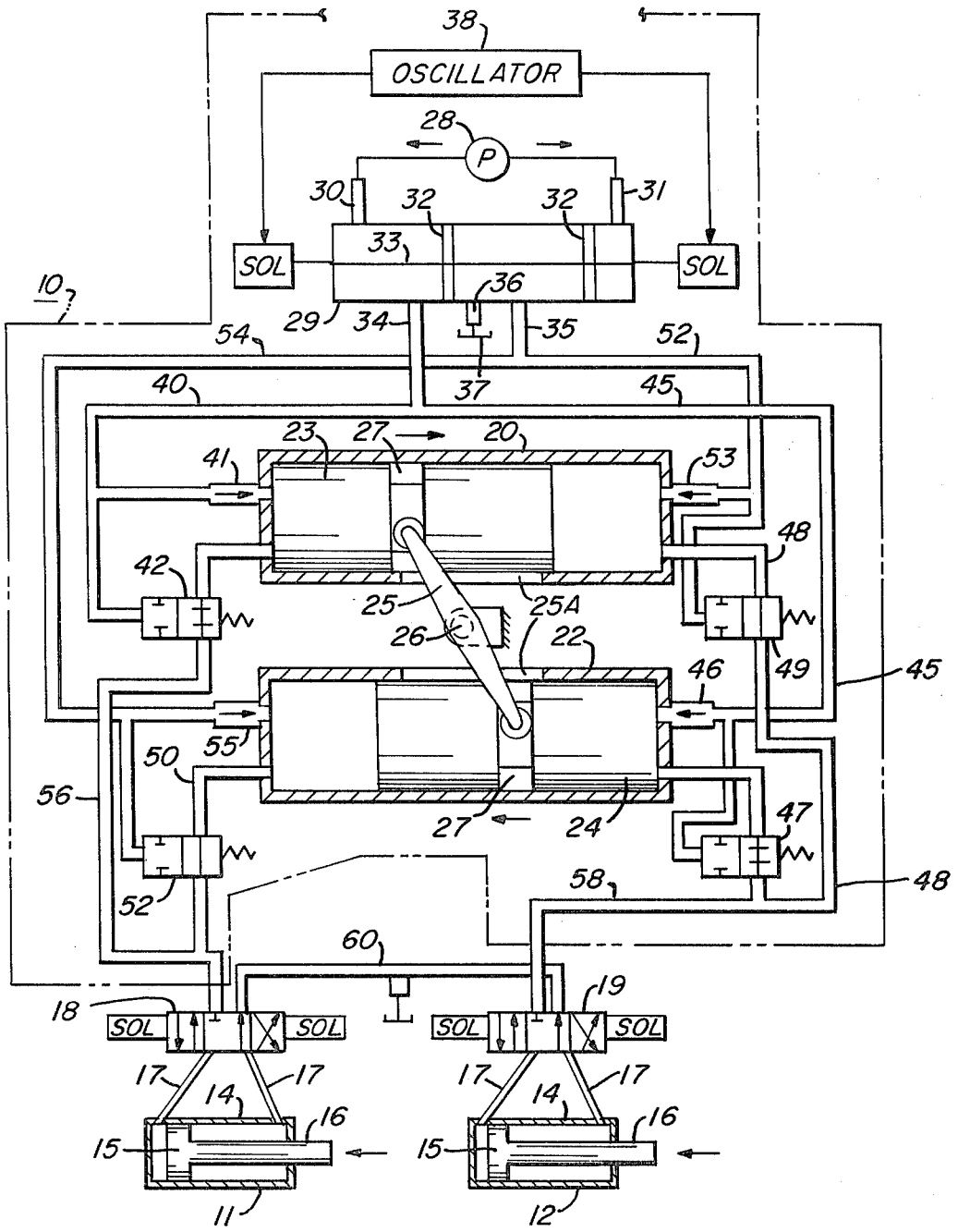
FIG. 1 is a schematic diagram of a hydraulic system embodying the invention, showing the pistons in one extreme position.
Figure 2:
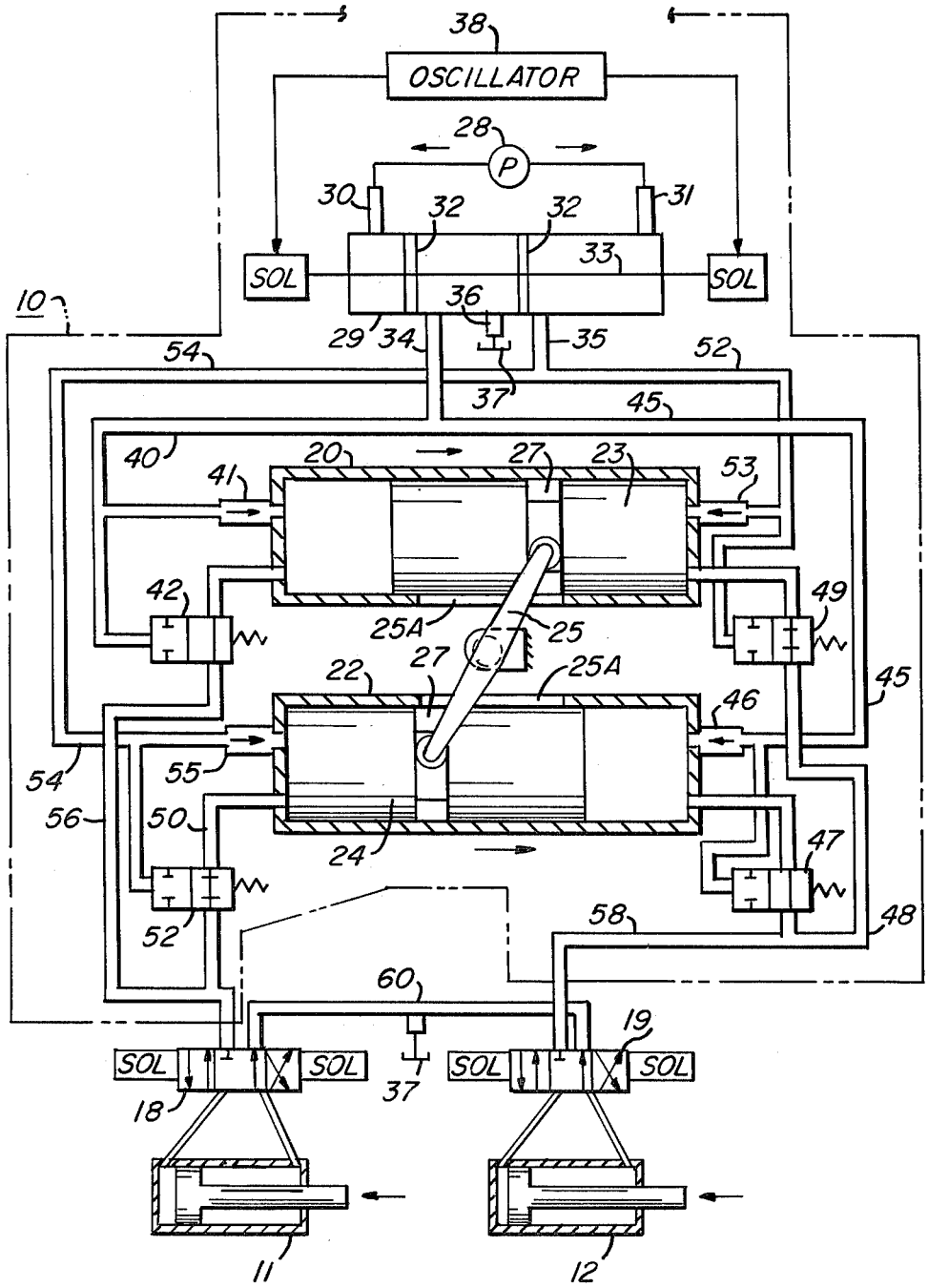
FIG. 2 is a diagram similar to FIG. 1 showing the pistons in their other extreme position.

The invention is shown in the drawings embodied in a hydraulic synchronizer unit 10 for supplying hydraulic fluid to two actuators 11 and 12. FIGS. 1 and 2 show identical parts, the only difference being that in FIG. 1 the pistons in cylinders 20 and 22 are shown in one extreme positions and in FIG. 2 at the opposite extreme positions. The actuators 11 and 12 may be of any suitable type and are each shown as consisting of a cylinder 14 with a piston 15 movable in the cylinder to actuate a rod 16 which is connected to a device or element to be moved. Each cylinder 14 has ports at each end with conduits 17 connected to the ports for supply and discharge of hydraulic fluid. The actuators 11 and 12 are preferably of identical construction and are intended to be utilized for operating devices, such as thrust reversers for aircraft jet engines, which must be moved as closely as possible in exact synchronism with each other. The synchronizer 10 functions as a source of hydraulic fluid for the actuators 11 and 12 to supply precisely identical quantities of hydraulic fluid to both actuators simultaneously so that they move together in exact synchronism. The movement of the actuators 11 and 12 is controlled by control valves 18 and 19, respectively, which may be conventional solenoid-operated valves of any suitable type, and which are shown as standard four-way, three-position valves to direct the hydraulic fluid to either end of the actuator or to shut it off from the actuator.

The synchronizer 10 is essentially a two-piston pump which functions to supply hydraulic fluid to the actuators 11 and 12 through their respective valves 18 and 19. The synchronizer 10 has two hydraulic cylinders 20 and 22 which are preferably substantially identical, although as explained below it is not necessary for them to be exactly the same. The cylinder 20 contains a piston 23 and the cylinder 22 contains a piston 24. The two pistons are reciprocably movable in their respective cylinders and are mechanically connected together by an arm 25 which is shown as being pivoted at a fixed point 26 outside of and between the cylinders and which passes through a slot 25A in the wall of each cylinder. Each end of the arm 25 is pivoted in a space or recess 27 in the center of one of the pistons. The pivot 26 is located at the midpoint of the arm 25, and it will be seen that the pistons 23 and 24 are constrained by the arm 25 to move simultaneously in opposite directions through exactly equal distances.

The pistons 23 and 24 are driven back and forth in their respective cylinders by means of hydraulic fluid supplied alternately to opposite ends of the cylinders. The hydraulic fluid is supplied to the cylinders from a pump 28, or other source of high-pressure hydraulic fluid, and is controlled by a servo valve 29. The valve 29 is shown diagrammatically as being a reciprocating, solenoid-operated valve with admission or inlet ports 30 and 31 at opposite ends for the high-pressure fluid and having lands 32 on a reciprocatory valve stem 33. In the position shown in FIG. 1, the valve 29 is in its right-hand position and the fluid inlet port 30 is connected to an outlet port 34, while a return port 35 is connected to a discharge port 36 which discharges hydraulic fluid to a reservoir or sump 37, or otherwise returns it to the system. The valve 29 is controlled by an electronic oscillator 38, which may be of any suitable type, and which energizes the solenoids to reciprocate the valve at a desired frequency which is preferably adjustable and may be as high as 50 cycles per second, for example.

In the position of the valve 29 shown in FIG. 1, high-pressure hydraulic fluid is supplied from the port 34 through a conduit 40 and a check valve 41 to the left-hand end of the cylinder 20, and is also supplied to a valve 42. The valve 42 may be a conventional cut-off valve which is spring-loaded to normally hold it in the open position but which is closed by hydraulic pressure in the conduit 40. Hydraulic fluid from the port 34 is also supplied through a conduit 45 and a check valve 46 to the right-hand end of the cylinder 22, and to a spring-loaded shut-off valve 47 which may be similar to the valve 42 described above and which is held in the closed position by hydraulic pressure in the conduit 45.

The fluid thus supplied to the left-hand end of cylinder 20 causes the piston 23 to move to the right, and hydraulic fluid contained in the right-hand end of the cylinder 20 is thus forced to flow out through a conduit 48 and valve 49. A check valve 53 is held closed at this time by a spring, not shown, to prevent fluid from discharging to a conduit 52. The valve 49 is similar to the valves 42 and 47 but is in the open position at this time since no hydraulic pressure is applied to it. The hydraulic fluid therefore flows through the conduit 48 to the control valve 19 and the actuator 12. At the same time, the hydraulic fluid supplied to the right-hand end of cylinder 22 is driving the piston 24 to the left. This causes hydraulic fluid contained in the left-hand end of cylinder 22 to flow out through a conduit 50 and normally-open shut-off valve 51 similar to the valve 49. The valve 51 is open at this time and the hydraulic fluid in the conduit 50, therefore, flows to the control valve 18 and the hydraulic actuator 11. A check valve 55 is held closed at this time by a spring, not shown, to prevent fluid from discharging to conduit 54.

The pistons 23 and 24 thus move in opposite directions in their respective cylinders to the positions shown in FIG. 2, and at the end of their travel the valve 29 is moved by the oscillator 38 to the position shown in FIG. 2. The admission port 31 is now connected to the port 35, and the port 34 is connected as a return port to the discharge port 36. The hydraulic fluid is now supplied from port 35 through conduit 52 and check valve 53 to the right-hand end of the cylinder 20, and through conduit 54 and check valve 55 to the left-hand end of cylinder 22. At this time, check valve 41 is held closed by a spring to prevent fluid from discharging to conduit 40 and the valve 42 is opened by its spring, since it is relieved of hydraulic pressure, while the valve 49 is closed by the pressure in the conduit 52. Similarly, check valve 46 is now held closed by a spring to prevent fluid from discharging to conduit 45 and the valve 47 is relieved of pressure and allowed to open while the valve 51 is closed by pressure in the conduit 54. There is no flow of oil in these lines at this time.

The hydraulic pressure thus applied to opposite ends of the two cylinders causes the piston 23 to move to the left in cylinder 20 and causes the piston 24 to move to the right in cylinder 22. Movement of the piston 23 to the left causes hydraulic fluid contained in the left-hand end of the cylinder 20 to flow through the now open valve 42 and a conduit 56 to the control valve 18 and the actuator 11. At this time, movement of the piston 24 to the right causes hydraulic fluid in the right-hand end of cylinder 22 to flow through the open valve 47 and a conduit 58 to the control valve 19 and the actuator 12. When the pistons 23 and 24 reach the ends of their respective movements, they have returned to the positions of FIG. 1 and one cycle or stroke of the synchronizer 10 is complete. The valve 29 is controlled, as described above, so that hydraulic fluid is supplied alternately to opposite ends of each cylinder and the pistons reciprocate so that the cycle just described is repeated continuously at a rate determined by the frequency of the oscillator 38.

It will be seen that on each complete stroke of the twin-piston pump, hydraulic fluid is forced from each cylinder first into one of the actuators and then into the other of the actuators. That is, on each stroke, each actuator receives hydraulic fluid first from one cylinder and then from the other, so that the total amount of hydraulic fluid supplied to each actuator is the sum of quantities of fluid received from both cylinders. Since the two pistons are constrained by the arm 25 to move together through exactly the same distance, the total amount of fluid received by each actuator during each complete stroke is identical to that received by the other actuator, since each actuator receives the same amount of fluid from each cylinder. It is, therefore, not necessary for the diameters of the cylinders, or the areas of the pistons, to be the same and considerable difference is permissible as long as the diameters at both ends of each cylinder are the same. The rate of reciprocation of the pistons 23 and 24 is determined by the frequency of the oscillator 38 which drives the valve 29 and may be made relatively high, and may be adjusted to regulate the output flow of the synchronizer as desired. Thus, for example, the frequency of the oscillator 38 may be as high as 50 cycles per second, so that the output flow of fluid to the actuators 11 and 12 pulsates at a high enough frequency to be essentially a continuous flow which is directed to the actuators by the associated control valves 18 and 19. The actuators thus move smoothly in precise synchronism, the direction and length of the stroke of the actuators being determined by the positions of the valves 18 and 19 which direct the fluid to one end or the other of the actuators, or cut it off from the actuators. Fluid discharged from the actuators is returned to the reservoir 37 by conduit 60.

The oscillator 38 can be made adjustable and can be programmed to drive the valve 29 to cause the pistons 23 and 24 to reciprocate back and forth in their respective cylinders in any desired manner. The cylinders 20 and 22, and pistons 23 and 24, are preferably made of relatively small size and light weight to minimize the inertia of the pistons to facilitate rapid reversal of their direction, and also to reduce the space requirements and weight of the synchronizer 10. If desired, the oscillator 38 can be set to reverse the movement of the pistons 23 and 24 shortly before they reach the ends of the cylinders 20 and 22 in order to prevent impact at the end of each stroke. The frequency can also be made variable and the oscillator can be programmed to reduce the frequency near the end of the stroke of the actuators 11 and 12 in order to provide a snubbing action. The pistons and cylinders may, of course, be of any desired type of construction with any suitable type of seals. If desired, the central space 27 in each piston in which the arm 25 is pivoted could be pressurized to prevent differential pressure across the seals at each end of the piston.

It will now be apparent that a hydraulic synchronizer has been provided which supplies precisely identical amounts of high-pressure hydraulic fluid to two separate hydraulic actuators to cause them to move in exact synchronism. This is done by a two-piston pump but, as previously explained, it is not necessary for the two cylinders of the pump to be identical since the amount of fluid supplied to each actuator on each complete stroke of the pump is the sum of similar contributions from both of the cylinders, so that exactly the same amount of fluid is supplied to each actuator. The length of travel of both pistons is identical, since they are mechanically tied together, and the exact length of stroke, therefore, is not critical. The synchronizer can be made of relatively small size and light weight, and the dimensions are not critical and may vary within reasonable limits, as explained above, so that it may be easily produced. The accuracy obtainable, however, is of the order of 0.10%, as compared with accuracies of the order of 5% or more which was the best obtainable with previously-known synchronizers for the same purpose.

If more than two actuators need to be synchronized, another set of cylinders 20 and 22, and pistons 23 and 24, mechanically tied to arm 25 and associated valves and operated by the same servo valve, can be added for each additional pair of actuators.

I claim as my invention:

1. In combination, first and second hydraulic cylinders having pistons movable therein, first and second hydraulic actuators, means for supplying hydraulic fluid to said cylinders to drive the pistons back and forth therein, valve means for directing fluid to flow from the first cylinder to the first actuator and from the second cylinder to the second actuator upon movement of the pistons in one direction and for directing fluid to flow from the first cylinder to the second actuator and from the second cylinder to the first actuator upon movement of the pistons in the opposite direction, and mechanical means interconnecting said pistons for causing said pistons to move simultaneously through equal distances.

2. The combination defined in claim 1 in which said mechanical means comprises an arm pivoted at its midpoint and having each end connected to one of the pistons.

3. The combination defined in claim 1 including control valve means for supplying hydraulic fluid to the cylinders to cause continuous reciprocating movement of the pistons.

4. The combination defined in claim 3 in which said control valve means includes a servo valve having two positions for supplying hydraulic fluid to opposite ends of both cylinders, and oscillator means for causing the servo valve to move between said two positions to supply fluid alternately to opposite ends of the cylinders.

5. The combination defined in claim 4 including an electronic oscillator adapted to drive said servo valve back and forth between said two positions at a predetermined frequency.

6. The combination defined in claim 4 including means for mechanically connecting said pistons together to cause them to move simultaneously through equal distances.

7. The combination defined in claim 6 and further including a direction control valve associated with each of said actuators for controlling the direction of stroke of the actuators.

* * * * *